US011502422B2

(12) United States Patent
Wangsvick et al.

(10) Patent No.: US 11,502,422 B2
(45) Date of Patent: Nov. 15, 2022

(54) CONFORMAL RF ANTENNA ARRAY AND INTEGRATED OUT-OF-BAND EME REJECTION FILTER

(71) Applicant: Raytheon Company, Waltham, MA (US)

(72) Inventors: Chad M. Wangsvick, Tucson, AZ (US); Michael E. Gomez, Tucson, AZ (US); William D. Ake, Tucson, AZ (US); Leonard Santa-Cruz, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 240 days.

(21) Appl. No.: 17/004,870

(22) Filed: Aug. 27, 2020

(65) Prior Publication Data

US 2022/0069479 A1 Mar. 3, 2022

(51) Int. Cl.

| | |
|---|---|
| ***H01Q 1/28*** | (2006.01) |
| ***H01Q 21/06*** | (2006.01) |
| ***H01Q 5/47*** | (2015.01) |

(52) U.S. Cl.

CPC ..... *H01Q 21/065* (2013.01); *H01Q 1/28* (2013.01); *H01Q 5/47* (2015.01)

(58) Field of Classification Search

CPC ..... H01Q 21/065; H01Q 5/47; H01Q 1/38; H01Q 1/28; H01Q 1/286; H01Q 9/0421

See application file for complete search history.

(56) References Cited

U.S. PATENT DOCUMENTS

| | | | | |
|---|---|---|---|---|
| 3,803,623 | A | 4/1974 | Charlot | |
| 4,079,268 | A | 3/1978 | Fletcher et al. | |
| 4,320,402 | A | 3/1982 | Bowen | |
| 4,605,932 | A * | 8/1986 | Butscher | H01Q 21/20 343/708 |
| 8,836,596 | B2 | 9/2014 | Richards et al. | |
| 8,860,532 | B2 | 10/2014 | Gong et al. | |
| 9,172,145 | B2 * | 10/2015 | Puzella | H05K 1/0206 |
| 10,396,462 | B2 | 8/2019 | Chopra | |
| 11,088,730 | B2 * | 8/2021 | Rogers | H01Q 21/065 |
| 2009/0046029 | A1 | 2/2009 | Nagai | |

(Continued)

OTHER PUBLICATIONS

Miao, Zhuo-Wei, et al., "Investigations on the Conformal Capability of the Substrate Integrated Waveguide (SIW) Technique for mm-wave Applications", 2016 IEEE International Workshop on Electromagnetics: Applications and Student Innovation Competition (iWEM), (2016), pp. 1-3.

(Continued)

*Primary Examiner* — Awat M Salih

(74) *Attorney, Agent, or Firm* — Schwegman Lundberg & Woessner, P.A.

(57) ABSTRACT

A datalink such as used on high-speed vehicles (missiles, guided-projectiles, manned or unmanned aircraft) includes an integrated conformal antenna array and out-of-band rejection filter for use with an RF radio. Integration of a single rejection filter between the EME power received by the antenna array and the coaxial RF connector effectively protects the connector as well as the radio. The connector can now be designed based solely on the transmit power requirements of the radio. The resultant connector is smaller and takes up less space inside the vehicle.

20 Claims, 9 Drawing Sheets

(56) References Cited

U.S. PATENT DOCUMENTS

| | | | | |
|---|---|---|---|---|
| 2013/0050015 | A1* | 2/2013 | Black | H01Q 21/20 342/175 |
| 2019/0067794 | A1 | 2/2019 | Klein et al. | |
| 2020/0212582 | A1* | 7/2020 | Rogers | H01Q 21/062 |
| 2020/0227814 | A1 | 7/2020 | Rogers | |

OTHER PUBLICATIONS

"International Application Serial No. PCT/US2021/038927, International Search Report dated Sep. 28, 2021", 4 pgs.
"International Application Serial No. PCT/US2021/038927, Written Opinion dated Sep. 28, 2021", 9 pgs.

* cited by examiner

CONFORMAL RF ANTENNA ARRAY AND INTEGRATED OUT-OF-BAND EME REJECTION FILTER

GOVERNMENT LICENSE RIGHTS

This invention was made with government support under Contract Number N00024-18-C-5431 awarded by the Department of Defense. The U.S. Government has certain rights in this invention.

BACKGROUND OF THE INVENTION

Field of the Invention

This invention relates to conformal RF antenna arrays and more particularly to the integration of an out-of-band EME (Electro-Magnetic Environment) rejection filter for high power EME emissions.

Description of the Related Art

Bi-directional radio frequency (RF) datalinks that include an RF antenna and a radio e.g. a transceiver (Tx/Rx) are commonly used for communications. Certain applications such as missiles, guided-projectiles, manned or unmanned aircraft, ships or land vehicles require the RF antenna being "conformal" e.g. conforms or matches, and is flat to, a prescribed curvature of the vehicle body. In general, this is to reduce aerodynamic drag. Conformal antennas are particularly required at high-speeds e.g. supersonic.

As shown in FIGS. 1, 2 and 3*a*-3*b*, a missile 10 is provided with a conformal phased array antenna 12 which includes an array of many identical small flat antenna elements 14 such as a patch, dipole or slot antenna, covering the surface as part of a datalink 15. Because the individual antenna elements must be small, conformal arrays are typically limited to a particular operating band of high frequencies between UHF, which 300 MHz on the low end to Ka-band, which is 40 GHz on the high end. At lower frequencies, the antenna elements and other structures get too large. At higher frequencies, the elements get small and require fabrication tolerances which are difficult to achieve with current manufacturing techniques.

At each antenna element the current from the transmitter passes through a phase shifter 16, which are controlled by one or more processors. By controlling the phase of the feed current, the nondirection radio waves emitted by the individual antennas can be made to combine in front of the antenna through interference, form a strong beam (or beams) or radio waves pointed in any desired direction. In a receiving antenna the weak individual radio signals received by each antenna element are combined in the correct phase to enhance signals coming from a particular direction. The phase shifters also compensate for the different phase shifts caused by the varying path lengths of the radio waves due to the location of the individual antennas on the curved surface. A feed network 18 distributes in transmission (combines in reception) the RF signal currents from a common node 20 to the many antenna elements. A "corporate" feed network splits the common node 1:N and then each subsequent node in the next stage 1:N until connected to the antenna elements. The number "N" can vary within or between stages. A binary feed network that splits each node 1:2 is quite common. In a fixed beam design, the fixed phase shifts can be designed into the feed network. The antenna elements, phase shifters, and feed network are fabricated on a multilayer conformal Antenna Board 21.

Common node 20 is electrically connected to one coaxial RF connector 22 of a mated connector pair. The mated connector 24 is connected via a cable 26 to a second mated coaxial RF connector pair coupled to radio 28 (e.g. the Tx/Rx) positioned inside the body of the missile. The mated connectors are impedance matched to the antenna feed. Radio 28 is not a conformal device. The radio 28 is a stack of planar datalink boards 30 that include the transmitter and receiver electronics 32 with discrete electronic components 34 such as chips, capacitors, etc., which are not conducive to a conformal stack.

An out-of-band rejection filter 36 such as a highpass filter (HPF), lowpass filter (LPF) or bandpass filter (BPF) is fabricated on one of the planar datalink boards as part of radio 28. The rejection filter 36 is configured to reject RF energy e.g. ElectroMagnetic Environment (EME) emissions, that are outside the operating band of the radio. Whether the rejection filter is a HPF, LPF or BPF depends on the operating band and the environement in which the datalink is operating (e.g. what is the nature of the EME emissions).

The mating connectors 22 and 24 must be designed to handle the RF power for both radio transmission and the out-of-band EME emissions. Depending upon the environment, the requirements to handle the EME emissions may be significantly higher than the radio transmission requirements requiring a physically larger connector.

FIGS. 3A and 3B illustrate embodiments of what are referred to as an SMA (SubMiniature version A) 40 and TNC (Threaded N Connector) 42 connectors that can be used to connect the conformal Antenna Board 21 to the Radio 28. Generally speaking the SMA connector is about one-half the length L and one half the diameter D of the TNC connector and can handle about one-half of the power. The TNC design is modified to include an overlapping dielectric (e.g. a Teflon sleeve on one connector that slides over a Teflon sleeve on the other connector) to eliminate any air gap to handle the additional power as well. For example, in C-band SMA can handle 400 W and TNC 800 W of power. In some applications, an SMA connector would be adequate to handle the in-band transmit power but a TNC connector is required to handle the higher out-of-band EME power.

In many applications, "volume" or space within the vehicle is very valuable. This is particularly true in missiles, guided-projectiles and small unmanned vehicles and even more so as their form factors are made smaller and smaller. The larger TNC connector albeit needed to survive the out-of-band EME emissions in many critical applications occupies valuable space.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides an integrated conformal antenna array and conformal out-of-band rejection filter for use with an RF radio to form a datalink such as used on high-speed vehicles (missiles, guided-projectiles, manned or unmanned aircraft). Integration of a single rejection filter between the EME power received by the antenna array and the coaxial RF connector effectively protects the connector as well as the radio. The connector can now be designed based solely on the transmit power requirements of the radio. The resultant connector is smaller and takes up less space inside the vehicle.

In an embodiment, the radio, which includes a stack of planar circuit cards configured to transmit and receive RF signals in an operating frequency band, is positioned inside the vehicle body. A first coaxial RF connector is coupled to the radio. A conformal antenna board has a non-planar shape that conforms to the curved surface of the vehicle body. The antenna board comprises a metal backing sheet that provides a bottom ground plane and at least one pair of a metal sheet cladding a layer of dielectric material with the bottom layer of dielectric material being disposed over the metal backing sheet. An array of microstrip antenna elements is patterned in the top metal sheet and configured to transmit and receive RF signals in an operating frequency band. A feed network comprising multiple levels of interconnected power dividers/combiners is patterned in the bottom metal sheet to connect the plurality of antenna elements to a common feed node. An out-of-band rejection filter is also fabricated in the bottom metal sheet that connects the common feed node to an RF pin that extends through a hole in the bottom ground plane. The out-of-band rejection filter is configured to reject electromagnetic environment (EME) energy outside the operating frequency band. A second coaxial RF connector has an internal conductor that is connected to the RF pin and an external conductor that is connected to the bottom ground plane and coupled to the first coaxial RF connector as a mated pair. The first and second coaxial RF connectors are configured to handle a specified power level above an in-band transmit power of the radio through the antenna array but less than a specified out-of-band EME power level.

In certain embodiments, the coaxial RF connectors handle a specified power level of 400 W or less in C-band. These connectors may be a SubMiniature version A (SMA) connector.

In different embodiments, the conformal antenna board is configured such that the feed network and out-of-band rejection filter are implemented as microstrips (conductive traces above the bottom ground plane) or striplines (conductive traces between top and bottom ground planes).

In different embodiments, the out-of-band rejection filter is configured as a LPF, HPF or BPF. The LPF and HPF comprise transmission lines designed to have frequency resonant or inductive and capacitive responses to provide a LPF or HPF response. The BPF is an edge coupled BPF in which sections of frequency resonant transmission lines are sized and spaced apart to provide the desired BPF response. In a stripline implementation, a plurality of conductive vias may be formed around the filter and terminated at opposing ends to the top and bottom ground planes to improve isolation.

These and other features and advantages of the invention will be apparent to those skilled in the art from the following detailed description of preferred embodiments, taken together with the accompanying drawings, in which:

DETAILED DESCRIPTION OF THE INVENTION

The present invention provides an integrated conformal antenna array and out-of-band rejection filter for use with an RF radio to form a datalink such as used on high speed vehicles (missiles, guided-projectiles, manned or unmanned aircraft). Integration of a single rejection filter between the EME power received by the antenna array and the coaxial RF connector effectively protects the connector as well as the radio. The connector can now be designed based solely on the transmit power requirements of the radio. The resultant connector is smaller and takes up less space inside the vehicle. For example, in applications in which a higher power TNC connector would be required to handle the out-of-band EME power a lower power SMA connector can be used.

Figure 4:
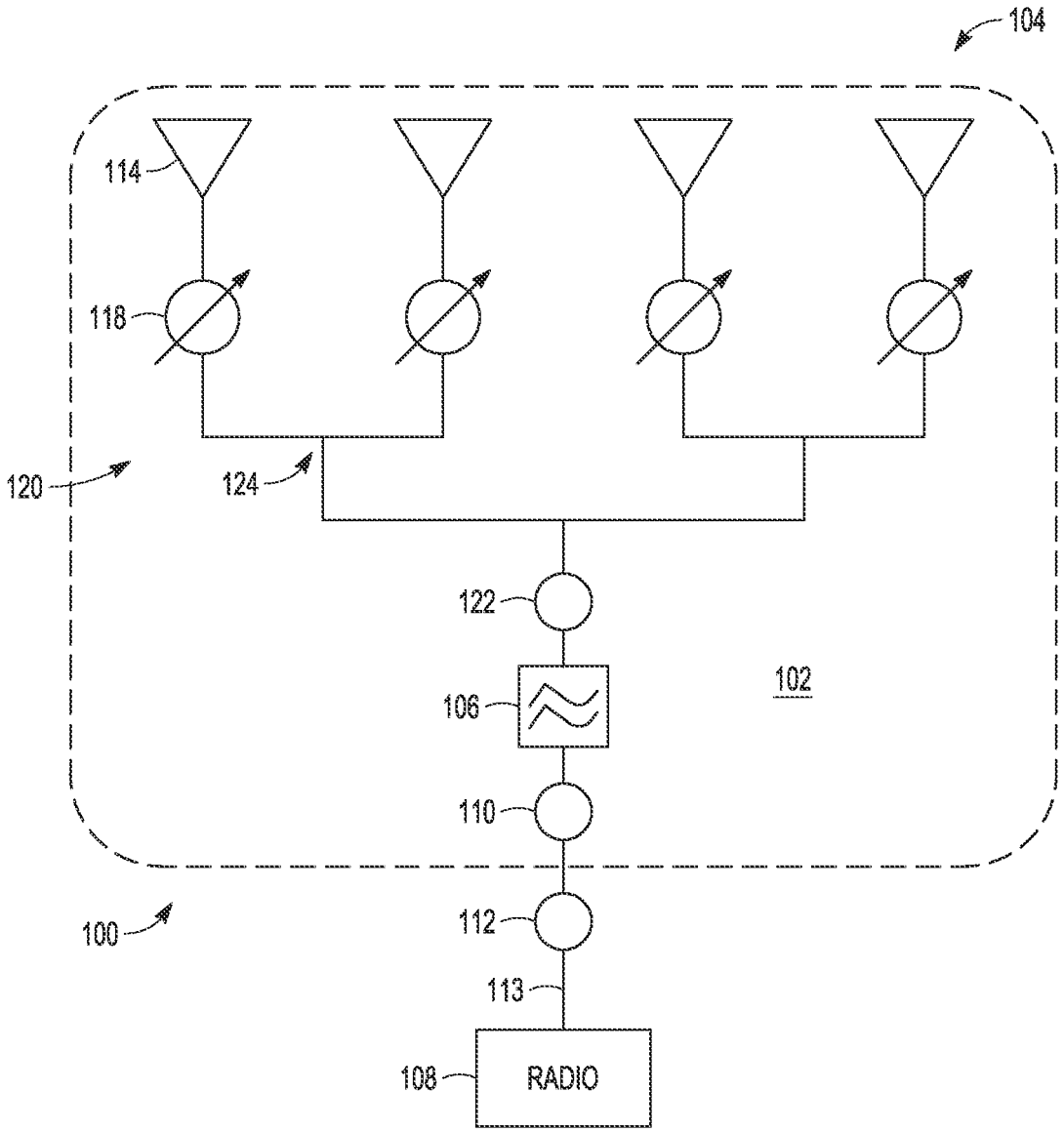
FIG. 4 is an illustration of a schematic diagram of an out-of-band rejection filter integrated with the conformal antenna array and connected to the radio.
Figure 5A:
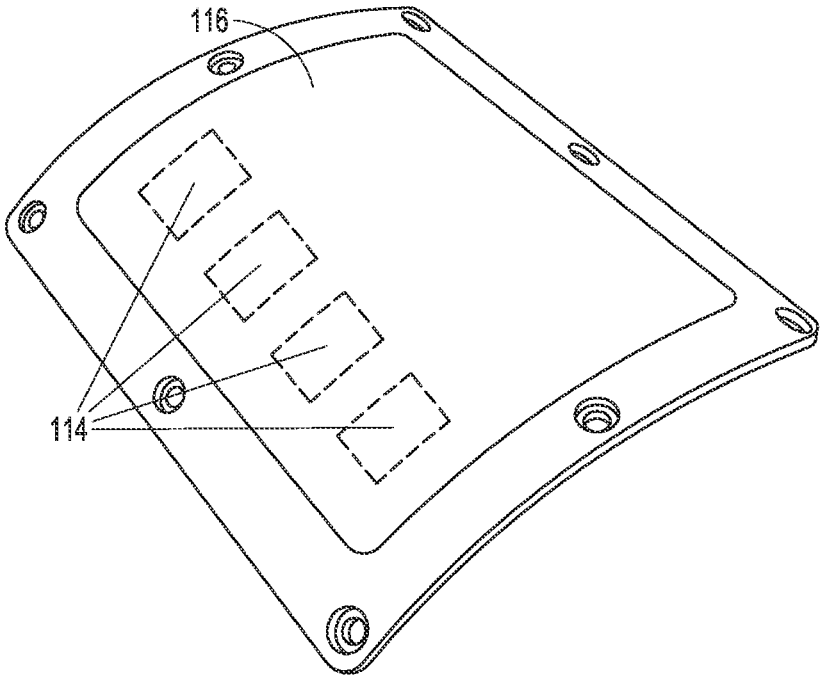
FIGS. 5A and 5B are illustrations of the front and back sides of the conformal antenna array showing the patch antenna elements and coaxial RF connector.
Figure 5B:
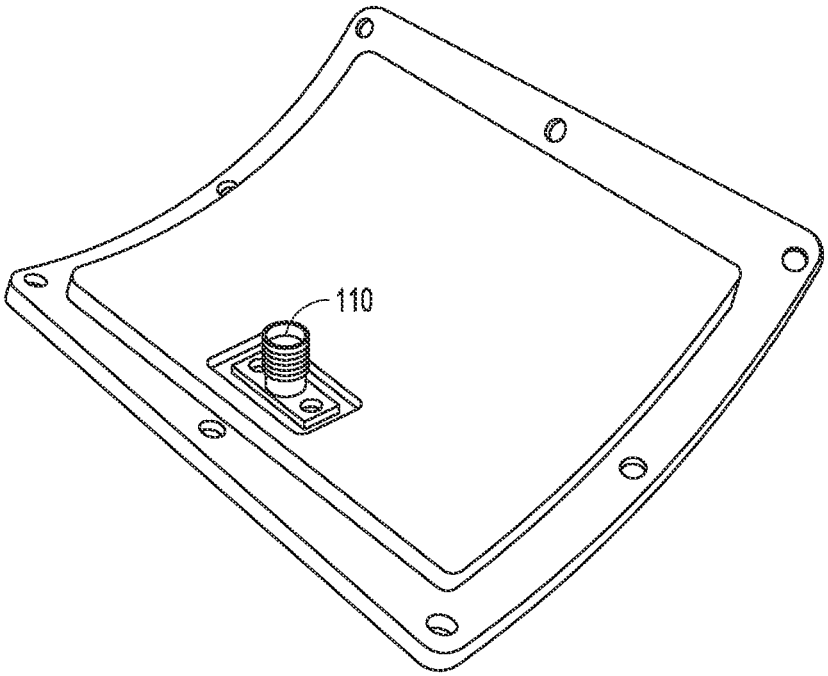

Referring now to FIGS. 4 and 5A-5B, an embodiment of a datalink 100 includes a conformal antenna board 102 including a phased antenna array 104 and an out-of-band rejection filter 106, which is coupled to a radio 108 via mating coaxial RF connectors 110 and 112. Antenna board 102 has a non-planar shape that conforms to the curved surface of the vehicle body. Radio 108, which is formed of a stack of planar circuit cards, is positioned inside the vehicle body. Coaxial RF connector 110 projects from antenna board 102 inside the vehicle body to mate with coaxial RF connector 112. A length of coaxial cable 113 runs to radio 108 where is coupled through another mated pair of coaxial RF connectors.

Phased array antenna 104 includes an array of many identical small flat antenna elements 114 such as a patch, dipole or slot antenna, which are just visible beneath the thermal insulating cover 116. The cover keeps the antenna elements, and other structures below the surface, at temperatures low enough that their properties can be well characterized. Because the individual antenna elements must be small, conformal arrays are typically limited to a particular operating band of high frequencies UHF (300 MHz to 1 GHz), L-band (1-2 GHz), S-band (2-4 GHz), C-band (4-8 GHz), X-band (8-12 GHz), Ku band (12-18 GHz), K-band (18-26 GHz) and Ka-band (26-40 GHz). At lower frequencies, the antenna elements and other structures get too large. At higher frequencies, the elements and fabrication tolerances get too small.

At each antenna element the current from the transmitter passes through a phase shifter 118, which are controlled by one or more processors. By controlling the phase of the feed current, the nondirection radio waves emitted by the individual antennas can be made to combine in front of the antenna through interference, form a strong beam (or beams) or radio waves pointed in any desired direction. In a receiving antenna the weak individual radio signals received by each antenna element are combined in the correct phase to enhance signals coming from a particular direction. The phase shifters also compensate for the different phase shifts caused by the varying path lengths of the radio waves due to the location of the individual antennas on the curved surface. A feed network 120 distributes in transmission (combines in reception) the RF signal currents from a common node 122 to the many antenna elements. The feednetwork includes multiple levels of interconnected power dividers/combiners 124. A "corporate" feed network splits the common node 1:N and then each subsequent node in the next stage 1:N until connected to the antenna elements. The number "N" can vary within or between stages. A binary feed network that splits each node 1:2 is quite common. In a fixed beam, fixed phase shifts can be designed into the feed network by varying the lengths of the legs that are connected to the antenna elements 114.

Common node 120 is electrically connected through rejection filter 106 coaxial RF connector 110 of a mated connector pair. The mated connector 112 is connected via a cable 113 to radio 108 (e.g. the Tx/Rx) positioned inside the body of the missile. The mated connectors are impedance matched to the antenna feed. Radio 108 is not a conformal device. The radio 108 is a stack of planar datalink boards that include the transmitter and receiver electronics with discrete electronic components such as chips, capacitors, etc., which are not conducive to a conformal stack.

Out-of-band rejection filter 106 such as a highpass filter (HPF), lowpass filter (LPF) or bandpass filter (BPF) is fabricated on the conformal antenna board 102. The rejection filter 106 is configured to reject RF energy e.g. ElectroMagnetic Environment (EME) emission, that is outside the operating band of the radio. Whether the rejection filter is a HPF, LPF or BPF depends on the operating band and the environment in which the datalink is operating (e.g. what is the nature of the EME emissions).

Integration of a single rejection filter 106 between the EME power received by the antenna array and the coaxial RF connector 110/122 effectively protects the connector as well as the radio. The connector can now be designed based solely on the transmit power requirements of the radio. The resultant connector is smaller and takes up less space inside the vehicle. For example, in applications in which a higher power TNC connector would be required to handle the out-of-band EME power a lower power SMA connector can be used.

Figure 1:
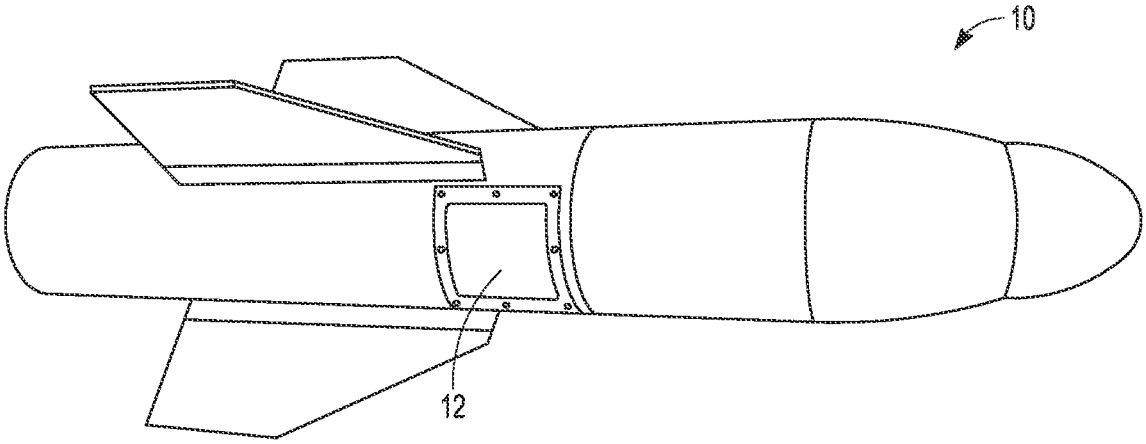
FIG. 1 (PRIOR ART)
FIG. 1, as described above, is an illustration of a conformal antenna array on a missile.
Figure 2:
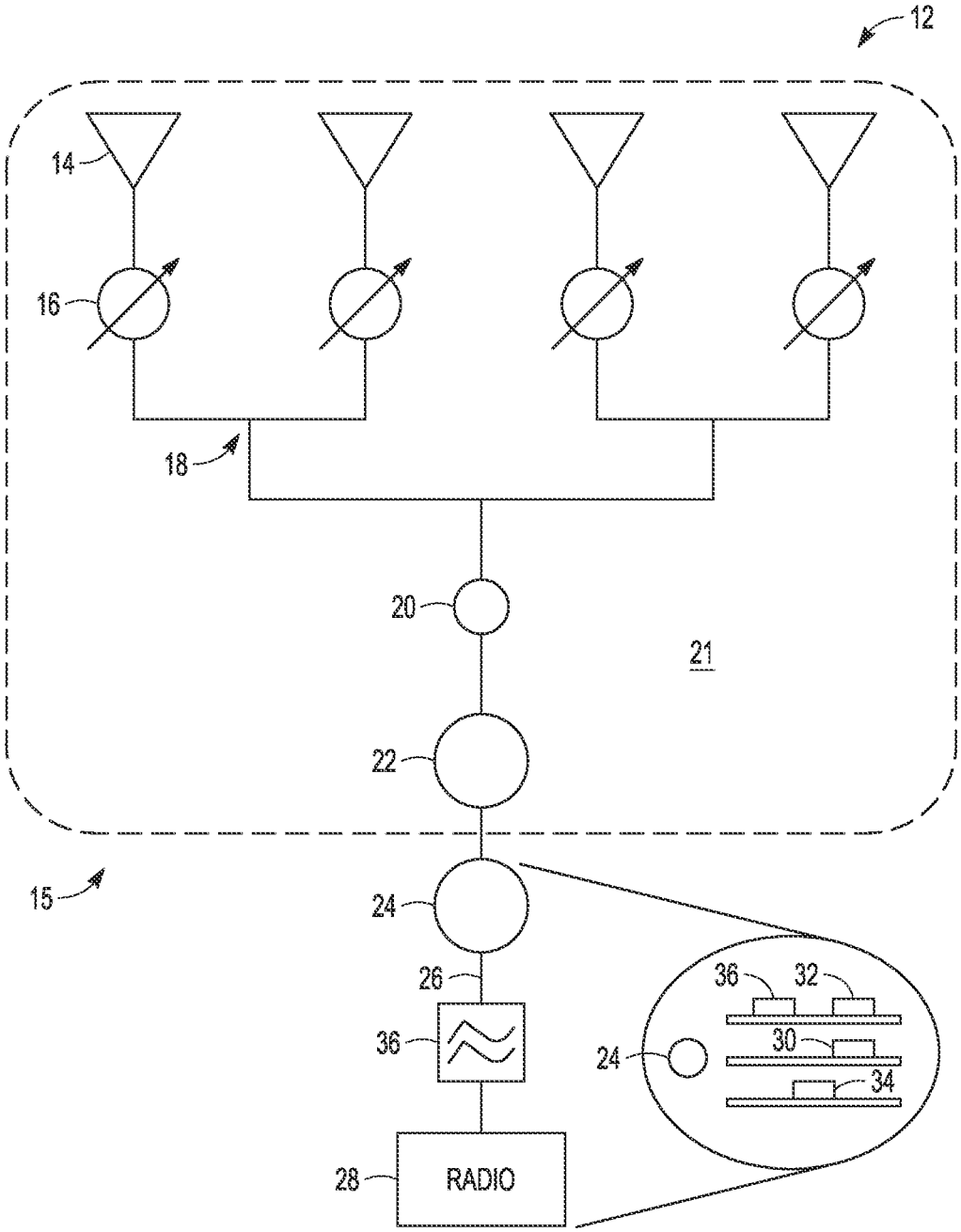
FIG. 2 (PRIOR ART)
FIG. 2, as described above, is an illustration of a schematic diagram of the conformal antenna array connected to an out-of-band rejection filter integrated with the radio.
Figure 3A:
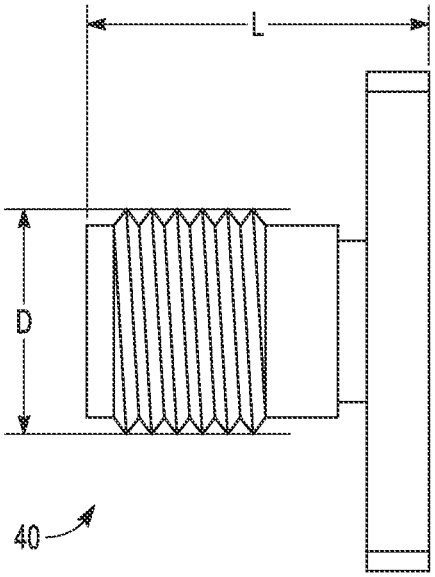
FIG. 3A (PRIOR ART)
FIGS. 3A and 3B, as described above, are illustrations of embodiments of SMA and TNC coaxial RF connectors.
Figure 3B:
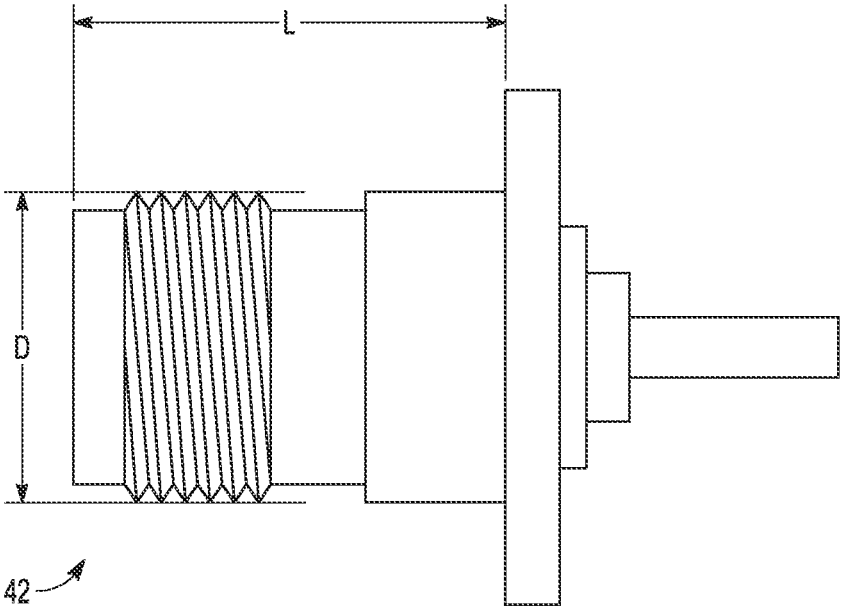
FIG. 3B (PRIOR ART)

Fabrication of electrical-mechanical structures in a multilayer board that must conform to a non-planar curved surface is a complicated and non-standard process. At RF frequencies, the structures must be redesigned to compensate for the curved surface. Furthermore, the board and the thermal insulating cover are prone to tracking if the board is too thick, the materials are too stiff or the radius of curvature is too small. In additional, all of the structures in the conformal antenna aboard may be subjected to very high temperatures (e.g. thermal heating of the vehicle surface at high speeds). Accordingly, when conformal antenna arrays are used standard practice (such as shown in FIG. 2) is to only include those structures that must reside on the curved surface of the vehicle in the conformal antenna board and move all other structures such as the radio and filter onto the planar circuit cards inside the vehicle body.

Integrating the fabrication of the rejection filter 106 on antenna board had to address and overcome each of these challenges. Although the same basic design topology of the rejection filter 106 is still used, the detailed design had to be modified to compensate for the different phase shifts caused by the varying path lengths of the radio waves due to the location of the individual conductive traces on the curved surface that make up the filter and to compensate for elevated operating temperatures and the presence of the thermal insulating cover.

Figure 6:
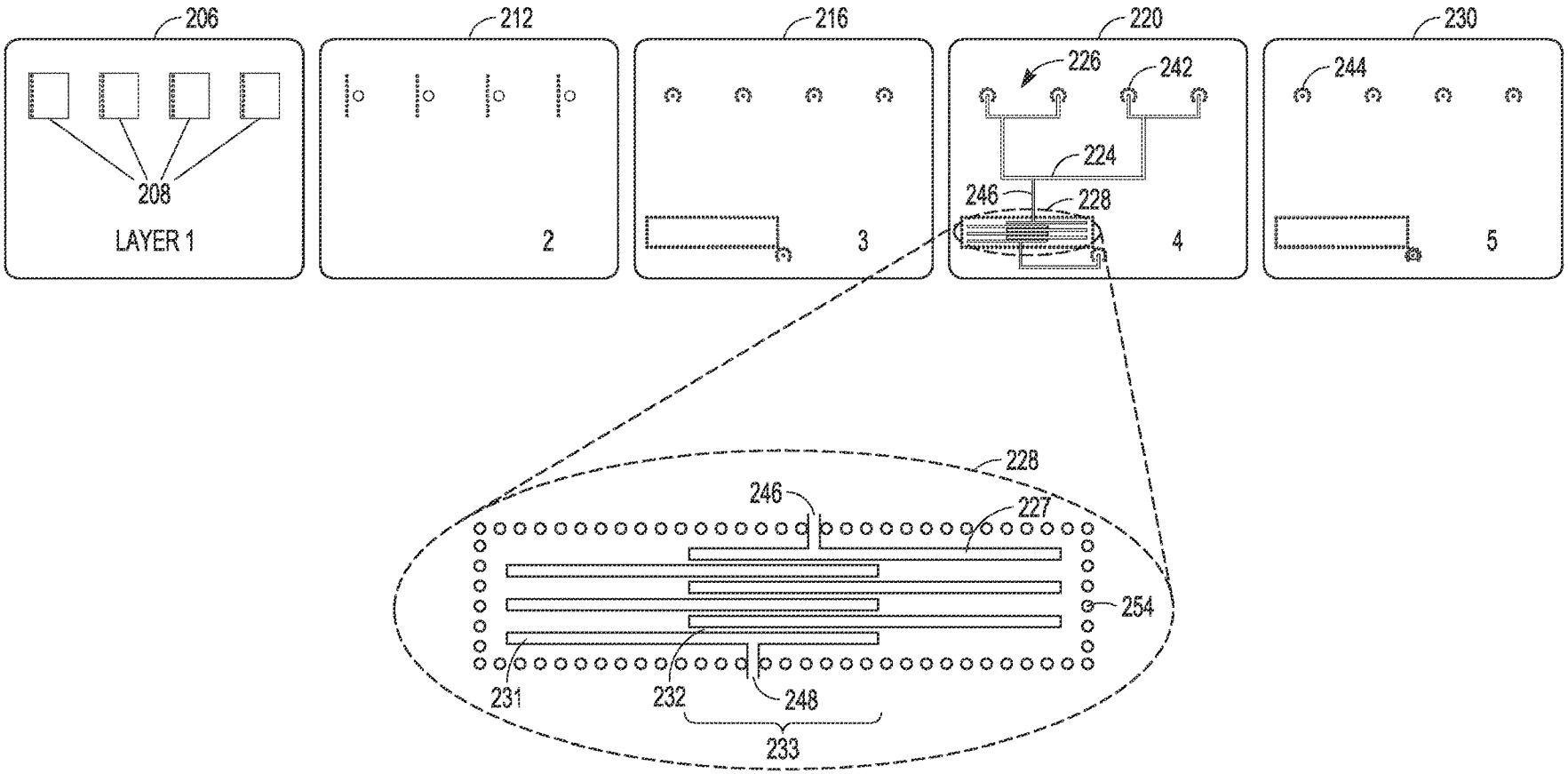
FIG. 6 is an illustration of an embodiment of the layers that form the integrated conformal antenna array and an edge coupled BPF in a stripline implementation.
Figure 7:
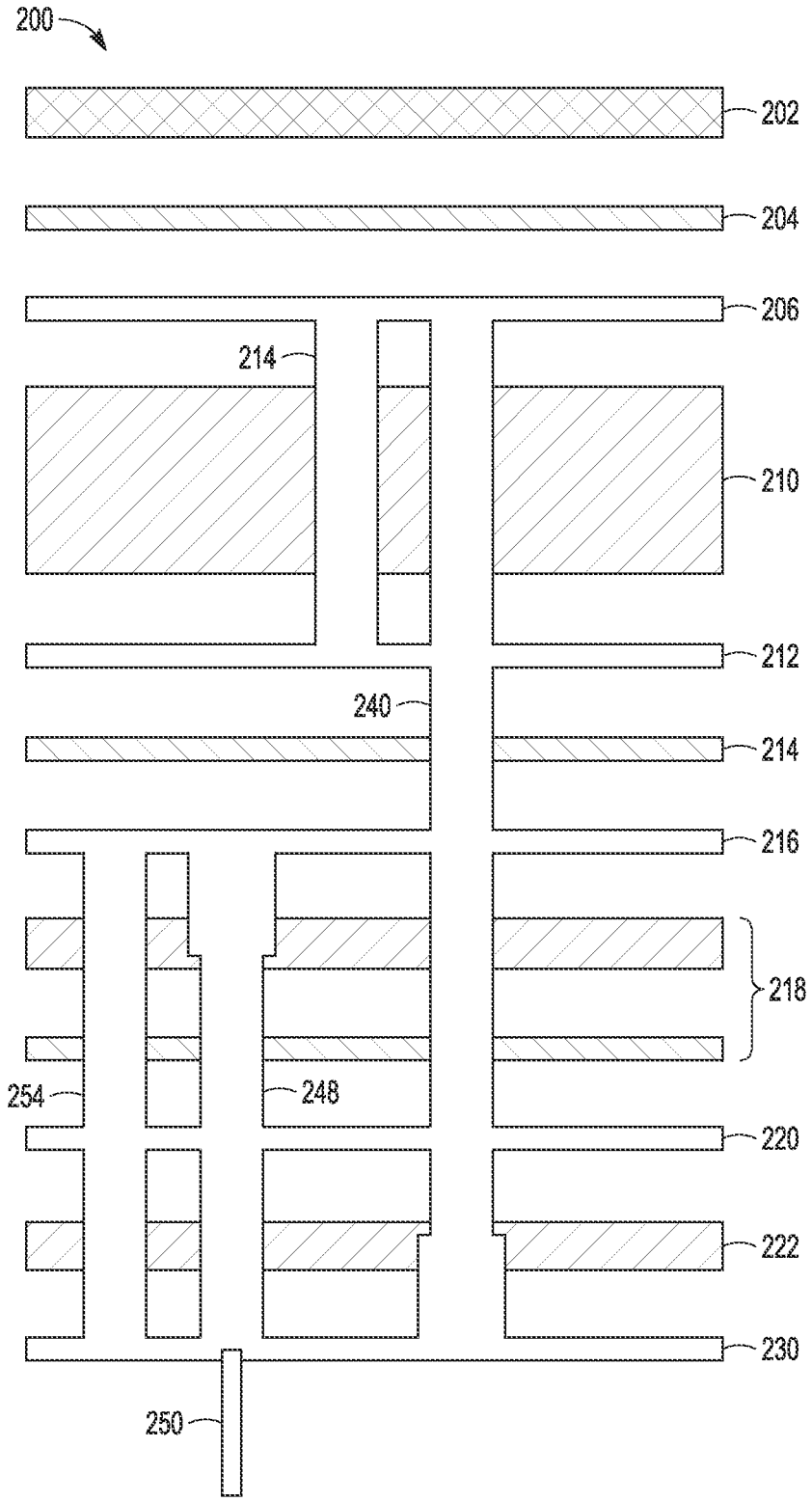
FIG. 7 is an illustration of an embodiment of a stack of the layers that form the integrated conformal antenna array and an edge coupled BPF in a stripline implementation.

FIGS. 6 and 7 illustrate an embodiment of a conformal 5-layer antenna board 200 in which the feed network and rejection filter are implemented as a stripline, the rejection filter is implemented as an edge-coupled BPF, the BPF is enclosed in a "via fence" and the ½ wavelength antenna elements are implemented as terminated ¼ wavelength antenna elements for an operating frequency band in the C-band of 4-8 GHz. Each "layer" corresponds to a metal sheet, which may form a ground plane or may be patterned to form transmission line (microstrip or stripline) structures. The dielectric layers that separate the metal sheets and the vias that connect structures between layers are not considered to be "layers" in this context. The dielectric materials are suitably less rigid, non-woven materials that are suitable for conforming to a curved surface. A thermal insulating cover ("radome") 202 is formed over and bonded to antenna board 200 with a thin film 204.

The topmost layer, layer 1 206, is suitably a 0.7 MTh copper sheet in which an array of microstrip antenna elements 208 are patterned. In this example, the antenna elements are "patches" and ¼ wavelength patches that are electrically terminated on one side such that the patches function as a ½ wavelength element in the RF band of interest. A "cladding" is an outer layer of material covering another. Layer 1 206 clads a thick 80 MTh layer of dielectric material 210. Layer 2 212 is suitably a 0.7 MTh copper sheet that forms a ground plane on which to terminate the antenna elements 208 with vias 214 formed through dielectric material 210. Layer 2 is not strictly required as the antenna elements could be terminated at another ground plane or ½ wavelength patches could be fabricated. This configuration allows for better control of the spacing between the antenna elements and the ground plane at which those elements are terminated. Layer 2 dads a thin 2 MTh layer of dielectric material 214.

Layer 3 216 is suitably a 0.7 MTh copper sheet that provides a top ground plane and dads a 15 and 2 MTh layers of dielectric material 218. Layer 4 220 is suitably a 0.7 MTh copper sheet that dads a 15 MIL layer of dielectric material 222. Traces 224 that define a feed network 226 and traces 227 that define an edge-coupled BPF 228 are patterned in Layer 4. The bottommost layer, layer 5, 230, is suitably a 0.7 MTh copper sheet that provides a bottom ground plane. The presence of top and bottom ground planes implements the feed network and BPF as "striplines", which improves isolation.

As illustrated, edge-coupled BPF 228 is fabricated from copper traces 227 that form a plurality of bars 231 the first of which is terminated to a common feed node 246 and the last of which is terminated to a via 248. The bars are oriented perpendicular to the direction that the RF signal energy is propagating from common feed node 246 to via 248 and spaced apart to for air gaps 232. Each bar is nominally ½ wavelength (center frequency of the operating band) in length. The number of bars, the length, the spacing of the air gap, the amount of overlap 233 between alternating bars determine the shape of the BPF. The edge coupled BPF works by having the signal resonate each filter 'bar' 231 at the frequency you wish to pass. The signal passes from one adjacent filter 'bar' 231 to the next across air gap 232. The filter performance is very sensitive to the air gaps between these 'bars'. If that changes, the impedance match will change, and/or the resonant frequency of the filter will change. The design of the conformal BPF had to accommodate change air gaps due to the curvature of the vehicle body.

Alternately, the rejection filter could be a LPF, a HPF or a combination of the two to form a BPF. A LPF/HPF have the same basic design but with different parameters. The design includes transmission lines designed to have frequency resonant or inductive and capacitive responses to provide a LPF or HPF response. A LPF can be designed by alternating a transmission lines width. Alternating narrow and wide sections of the transmission line will form a stepped impedance LPF. The length, width, and number of these alternating sections of the transmission line are determined based on design requirements and fabrication limitations. Both LPF and HPF can be designed using a transmission line with stubs that connect perpendicular to the line. These stubs are also transmission lines and are designed to be a multiple of a quarter-wave length of the design frequency. The stubs can also be open circuit or shorted to ground with a via to provide the desired LPF or HPF response. Multiple stubs can be added to the transmission line to provide better rejection. These multiple stubs are usually spaced a multiple of a quarter-wave length away from each other on the transmission line.

Vias 240 connect the antenna elements 208 in layer 1 to the N inputs 242 to feed network 226 in layer 4. In this fabrication implementation, vias 240 extend down to and terminate at layer 5 in holes 244 so they are not shorted to the bottom ground plane. The vias 240 could just as easily terminate at layer 4. Vias 240 connect the antenna elements through the feed network to the common feed node 246 on layer 4.

BPF 228 connects the common feed node 246 to via 248 to an RF pin 250 that extends through a hole 252 in layer 5 where it is connected to an internal conductor of a coaxial RF connector. Note, in this embodiment what appears as via 248 from layer 3 to 4 is actually dielectric material. In the fabrication, the top part of the via was backdrilled and filled.

A plurality of vias 254 are formed around the bandpass filter and electrically terminate at opposing ends at the Layer 3 top ground plane and the Layer 5 bottom ground plane to form a "via fence" 256 around the BPF. The fence is essentially a 3D EM cage around the BPF that isolates the BPF.

Figure 8:
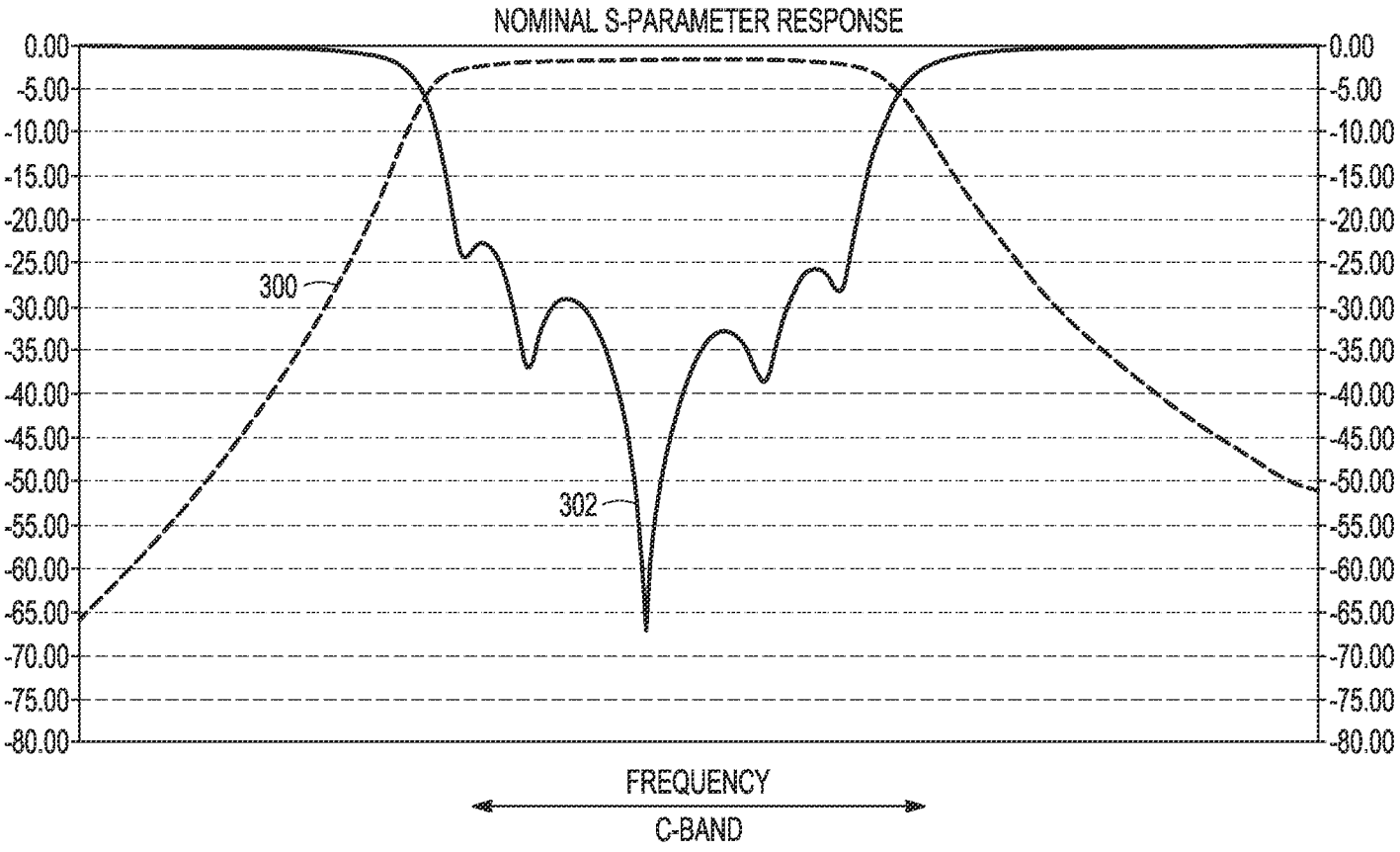
FIG. 8 is a plot of the edge coupled BPF filter performance including loss and reflected voltage in the C-band.
Figure 9:
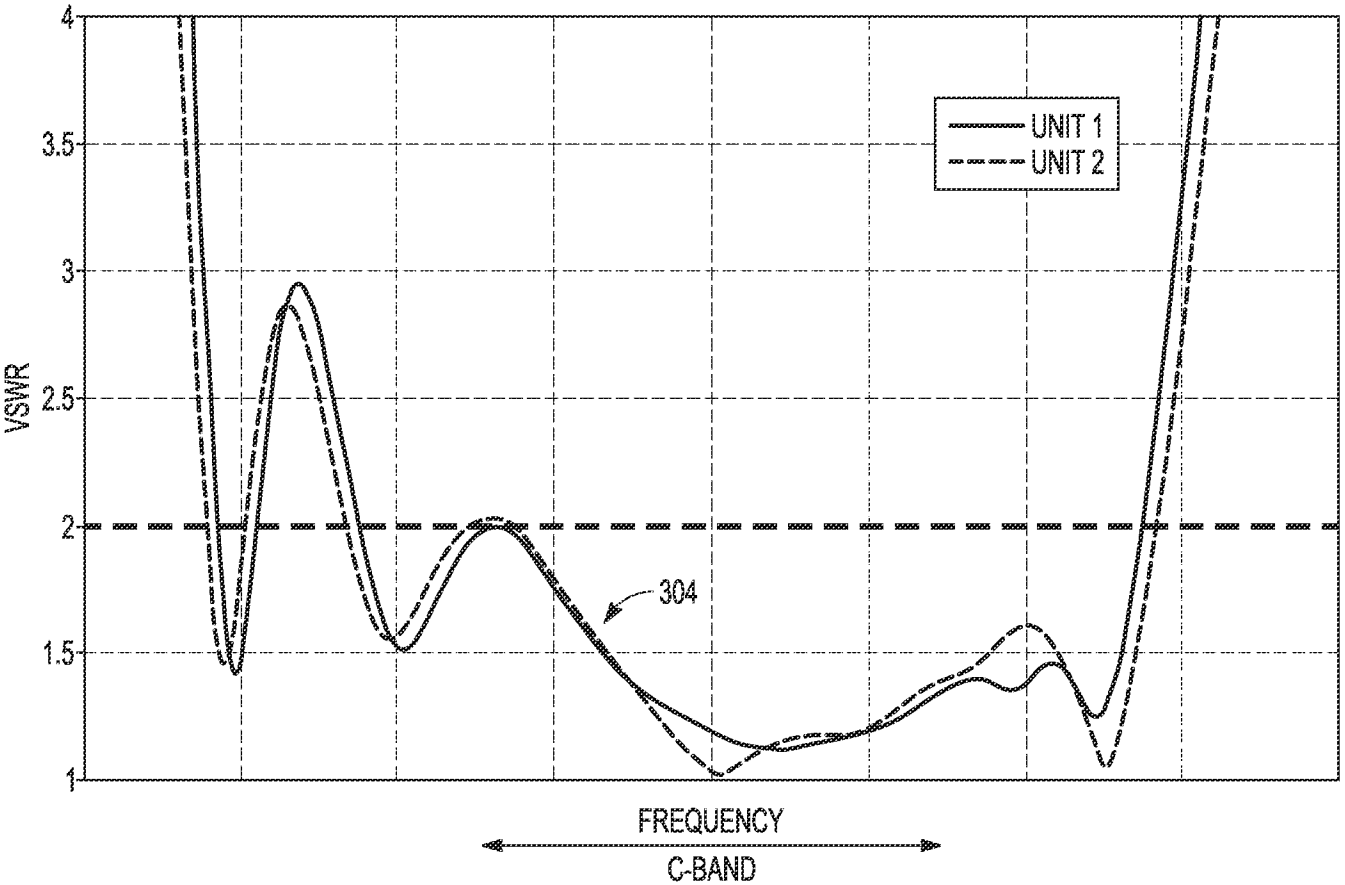
FIG. 9 is a plot of Voltage Standing Wave Ratio (VSWR) for the antenna array and BPF in the C-band.

Referring now to FIGS. 8 and 9, the performance of the C-band BPF is shown in a plot 300 that measures loss across the band and a plot 302 that measures mismatch/reflected voltage and the performance of the C-band phase antenna array and BPF is shown in a plot 304 that measures Voltage Standing Wave Ratio (VSWR). The plots indicate good performance of the integrated conformal phased antenna array and edge-coupled BPF across the C-band While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A conformal antenna array for flush mounting on a curved surface, said conformal antenna array comprising:

a metal backing sheet that provides a bottom ground plane, said metal backing sheet have a hole formed therein;

at least one pair of layers, each pair of layers comprising a metal sheet and a layer of dielectric material such that the metal sheet is cladding the layer of dielectric material, a bottom layer of dielectric material being disposed over the metal backing sheet;

wherein said metal backing sheet and said at least one pair of layers have a non-planar shape that conforms to the curved surface;

an array of microstrip antenna elements patterned in a top metal sheet, said array configured to transmit and receive RF signals in an operating frequency band;

a feed network comprising multiple levels of interconnected power dividers/combiners patterned in a bottom metal sheet to connect the plurality of antenna elements to a common feed node;

an out-of-band rejection filter fabricated in the bottom metal sheet that connects the common feed node to an RF pin that extends through the hole in the metal backing sheet, said out-of-band rejection filter configured to reject electromagnetic environment (EME) energy outside the operating frequency band; and a coaxial RF connector having an internal conductor that is connected to the RF pin and an external conductor that is connected to the metal backing sheet to bring in-band RF energy to and from the conformal antenna array.

2. The conformal antenna array of claim 1, wherein said coaxial RF connector is configured to withstand a specified maximum power level that is greater than a maximum in-band transmit power level through the antenna array but less than a specified out-of-band EME power level.

3. The conformal antenna array of claim 2, wherein the specified power level of the coaxial RF connector is 400 W or less in C-band.

4. The conformal antenna array of claim 3, wherein the coaxial RF connector is a SubMiniature version A (SMA) connector.

5. The conformal antenna array of claim 1, wherein a single out-of-band rejection filter provides the only filtering of EME for the antenna array.

6. The conformal antenna array of claim 1, wherein the out-of-band rejection filter is an edge-coupled bandpass filter (BPF) that passes RF signals in the operating frequency band and rejects RF signals outside the operating frequency band.

7. The conformal antenna array of claim 1, wherein said top and bottom metal sheets are the same metal sheet, wherein said power dividers/combiners that compose the feed network and the out-of-band rejection filter comprise metal traces positioned above the bottom ground plane to form microstrips.

8. The conformal antenna array of claim 1, wherein said at least one pair of layers comprises a first, second and third pairs of layers, each pair of layers comprising a metal sheet and a layer of dielectric material such that the metal sheet of each pair of layers is cladding the respective layer of dielectric material, wherein said bottom layer of dielectric material of the first pair is disposed over the metal backing layer, wherein said feed network and rejection filter are fabricated on the bottom metal sheet of the first pair, wherein said metal sheet of the second pair forms a top ground plane whereby said power dividers/combiners that compose the feed network and the out-of-band rejection filter that comprise metal traces positioned between the top and bottom ground planes to form striplines, wherein said microstrip antenna elements are fabricated on the top metal sheet of the third pair.

9. A conformal antenna array for flush mounting on a curved surface, said conformal antenna array comprising:

a metal backing sheet that provides a bottom ground plane, said metal backing sheet have a hole formed therein;

first, second and third pairs of layers, each pair of layers comprising a metal sheet and a layer of dielectric material such that the metal sheet of each pair is cladding the respective layer of dielectric material, said layer of dielectric material from said first pair being disposed over the metal backing sheet, said metal sheet from said second pair providing a top ground plane;

wherein said metal backing sheet and said first, second and third pairs of layers have a non-planar shape that conforms to the curved surface;

an array of microstrip antenna elements patterned in the metal sheet of the third pair, said array configured to transmit and receive RF signals in an operating frequency band;

a feed network comprising multiple levels of interconnected stripline power dividers/combiners patterned in the metal sheet of the first pair between the top and bottom ground planes that connect the plurality of antenna elements to a common feed node;

an edge-coupled stripline bandpass filter (BPF) fabricated in the bottom metal sheet of the first pair between the top and bottom ground planes that connects the common feed node to an RF pin that extends through the hole in the metal backing sheet, said edge-coupled stripline BPF configured to pass RF energy in the operating frequency band and reject electromagnetic environment (EME) energy outside the operating frequency band; and a coaxial RF connector having an internal conductor that is connected to the RF pin and an external conductor that is connected to the metal backing sheet to bring in-band RF energy to and from the conformal antenna array.

10. The conformal antenna array of claim 9, wherein said coaxial RF connector is configured to withstand a specified maximum power level that is greater than a maximum in-band transmit power level through the antenna array but less than a specified out-of-bound EME power level.

11. The conformal antenna array of claim 9, wherein the coaxial RF connector is a SubMiniature version A (SMA) connector.

12. The conformal antenna array of claim 9, wherein the edge-coupled BPF comprises a series of parallel conductive traces oriented perpendicular to a direction of flow of RF energy from the common feed node to the RF pin, each conductive trace being nominally one-half a wavelength at the center of the operating frequency, said parallel conductive traces spaced a specific distance apart to form air gap to provide ta specified BPF response.

13. The conformal antenna array of claim 9, further comprising:

a plurality of vias around the edge-coupled stripline BPF that are terminated on opposite ends to the top and bottom ground planes, respectively.

14. A vehicle datalink comprising:

a vehicle including a body having a curved surface;

a radio positioned inside the vehicle body, said radio including a stack of planar circuit cards configured to transmit and receive RF signals in an operating frequency band;

a first coaxial RF connector coupled to the radio;

a conformal antenna board having a non-planar shape that conforms to the curved surface of the vehicle body, said antenna board comprising:

a metal backing sheet that provides a bottom ground plane, said metal backing sheet have a hole formed therein;

at least one pair of layers, each pair of layers comprising a metal sheet and a layer of dielectric material such that the metal sheet is cladding the layer of dielectric material, a bottom layer of dielectric material being disposed over the metal backing sheet;

an array of microstrip antenna elements patterned in a top metal sheet, said array configured to transmit and receive RF signals in an operating frequency band;

a feed network comprising multiple levels of interconnected power dividers/combiners patterned in a bottom metal sheet to connect the plurality of antenna elements to a common feed node; and an out-of-band rejection filter fabricated in the bottom metal sheet that connects the common feed node to an RF pin that extends through the hole in the metal backing sheet, said out-of-band rejection filter configured to reject electromagnetic environment (EME) energy outside the operating frequency band; and a second coaxial RF connector having an internal conductor that is connected to the RF pin and an external conductor that is connected to the metal backing sheet and coupled to the first coaxial RF connector as a mated pair, said first and second coaxial RF connectors configures to bring in-band RF energy to and from the conformal antenna array, wherein said first and second coaxial RF connectors are configured to handle a specified maximum power level above a maximum in-band transmit power of the radio through the antenna array but less than a specified out-of-band EME power level.

15. The vehicle datalink of claim 14, wherein the specified power level of the coaxial RF connector is 400 W or less.

16. The vehicle datalink of claim 15, wherein the coaxial RF connector is a SubMiniature version A (SMA) connector.

17. The vehicle datalink of claim 14, wherein the vehicle is selected from one of a missile, guided-projectile, manned or unmanned aircraft, land vehicle or sea vehicle.

18. The vehicle datalink of claim 14, wherein the out-of-band rejection filter is an edge-coupled bandpass filter (BPF) that passes RF signals in the operating frequency band and rejects RF signals outside the operating frequency band.

19. The vehicle datalink of claim 14, wherein said top and bottom metal sheets are the same metal sheet, wherein said power dividers/combiners that compose the feed network and the out-of-band rejection filter comprise metal traces positioned above the bottom ground plane to form microstrips.

20. The vehicle datalink of claim 14, wherein said at least one pair of layers comprises a first, second and third pairs of layers, each pair of layers comprising a metal sheet and a layer of dielectric material such that the metal sheet of each pair of layers is cladding the respective layer of dielectric material, wherein said bottom layer of dielectric material of the first pair is disposed over the metal backing layer, wherein said feed network and rejection filter are fabricated on the bottom metal sheet of the first pair, wherein said metal sheet of the second pair forms a top ground plane whereby said power dividers/combiners that compose the feed network and the out-of-band rejection filter that comprise metal traces positioned between the top and bottom ground planes to form striplines, wherein said microstrip antenna elements are fabricated on the top metal sheet of the third pair.

* * * * *